US009163347B2

(12) United States Patent
Yang

(10) Patent No.: US 9,163,347 B2
(45) Date of Patent: Oct. 20, 2015

(54) DOOR LOCK CONTROL APPARATUS AND METHOD OF WASHING

(75) Inventor: Ha Yeong Yang, Hwaseong-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 1212 days.

(21) Appl. No.: 12/883,853

(22) Filed: Sep. 16, 2010

(65) Prior Publication Data

US 2011/0083476 A1 Apr. 14, 2011

(30) Foreign Application Priority Data

Oct. 13, 2009 (KR) ..... 10-2009-0097215

(51) Int. Cl.
*D06F 37/42* (2006.01)

(52) U.S. Cl.
CPC ..... *D06F 37/42* (2013.01)

(58) Field of Classification Search
CPC ..... D06F 37/42; D06F 39/14; D06F 2224/00; D06F 37/10; D06F 2204/082; D06F 2204/10; D06F 37/28; E05B 17/22; E05B 2047/0068; E05B 2047/0067; E05B 41/00; E05B 2047/0094; E05B 77/26; E05B 81/90; E05B 47/00
USPC ..... 68/5 E, 12, 12.02, 12.16, 12.17, 12.26, 68/12.27, 75, 196; 134/92, 184, 113, 134/57 DL, 58 DL, 56 R, 57 R, 188, 56 D; 8/148, 158, 159; 49/503, 506; 210/143; 200/61.64; 292/DIG. 69
See application file for complete search history.

(56) References Cited

U.S. PATENT DOCUMENTS

| | | | | |
|---|---|---|---|---|
| 4,120,013 | A * | 10/1978 | Simmons | 361/180 |
| 4,510,777 | A | 4/1985 | Ellingson et al. | |
| 4,866,955 | A | 9/1989 | Blair et al. | |
| 5,742,964 | A | 4/1998 | Choi | |
| 5,879,036 | A * | 3/1999 | Moline et al. | 292/210 |
| 2004/0211228 | A1 | 10/2004 | Nishio et al. | |

FOREIGN PATENT DOCUMENTS

| | | | |
|---|---|---|---|
| CN | 1540060 | A | 10/2004 |
| EP | 2 416 226 | A1 | 2/2012 |
| KR | 10-2005-0111043 | | 11/2005 |
| KR | 10-0839080 | | 6/2008 |
| KR | 10-2008-0078768 | | 8/2008 |

OTHER PUBLICATIONS

English Machine Translation of Description of KR1020080078768 (Won et al. 2008).*
European Search Report dated Oct. 28, 2010 issued in corresponding European Patent Application 10175686.4.

(Continued)

*Primary Examiner* — David Cormier
*Assistant Examiner* — Irina Graf
(74) *Attorney, Agent, or Firm* — Staas & Halsey LLP

(57) ABSTRACT

Disclosed herein are a door lock control device and method of a washing machine which sense opening or closing of a door using a door lock switch. Since the door is locked or unlocked and the closing or opening of the door is sensed using one door lock switch without adding a separate switch to sense the closing or opening of the door, cost may be decreased.

10 Claims, 6 Drawing Sheets

(56) References Cited

OTHER PUBLICATIONS

European Office Communication dated Oct. 17, 2013 in corresponding European Application No. 10 175 686.4.

Korean Office Action dated Sep. 27, 2013 in corresponding Korean Application No. 10-2009-0097215.

Chinese Office Action mailed Dec. 26, 2013 in corresponding Chinese Application No. 201010507183.8.

* cited by examiner

DOOR LOCK CONTROL APPARATUS AND METHOD OF WASHING

CROSS-REFERENCE TO RELATED APPLICATIONS

This application claims the benefit of Korean Patent Application No. 10-2009-0097215, filed on Oct. 13, 2009 in the Korean Intellectual Property Office, the disclosure of which is incorporated herein by reference.

BACKGROUND

1. Field

Embodiments relate to a door lock control apparatus and method of a washing machine which senses opening and closing of a door using a door lock switch.

2. Description of the Related Art

In general, a washing machine (generally, a drum type washing machine) includes a tub to contain water (washing water or rinsing water), a drum rotatably mounted in the tub to contain laundry, and a motor to generate driving force to rotate the drum, and washes the laundry by raising and dropping the laundry in the drum along the inner wall of the drum when the cylindrical drum is rotated.

In such a washing machine, a door is openably and closably provided such that the laundry is put into or taken out of the drum, and a door lock switch to lock the door such that the door is not opened during the operation of the washing machine is provided on one side of the door.

The door lock switch simultaneously performs a lock/unlock function of the door and a power on/off function of an electrical part. To this end, the electrical part is operated only when the door is closed, such that a user is protected from accidents during mechanical operation, such as the rotation of the drum.

In the door lock switch, a bimetal latch or a solenoid is used to perform the lock/unlock operation of the door. As the quality of a product is improved, a time consumed for lock/unlock is relatively increased. Thus, the solenoid scheme is preferred to the bimetal latch scheme. In order to reduce costs, even in the solenoid scheme, a method of controlling a lock/unlock operation by toggling one solenoid instead of two solenoids has been developed.

Recently, a door lock switch including a switch to sense opening or closing of a door in addition to a basic operation such as a lock/unlock operation of the door has been developed. When the door is not closed, the electrical part is not powered on so as to prevent Product Liability (PL) accidents in advance. However, since a separate switch is added to mechanically reject the opening or closing of the door, this door lock switch is not preferable in terms of cost reduction.

SUMMARY

Additional aspects and/or advantages will be set forth in part in the description which follows and, in part, will be apparent from the description, or may be learned by practice of the invention.

Therefore, it is an aspect to provide a door lock control apparatus and method of a washing machine, which performs a lock/unlock operation of a door and senses the closing or opening of the door using a door lock switch without adding a separate switch to sense the closing or opening of the door.

Additional aspects will be set forth in part in the description which follows and, in part, will be obvious from the description, or may be learned by practice of the invention.

In accordance with one aspect, there is provided door lock control device of a washing machine, the door lock control device including: a door; a door lock switch turned on/off according to closing or opening of the door to mechanically lock or unlock the door and to sense the closing or opening of the door; a sensor to sense an operation state of the door lock switch and to output a door closing/opening signal; and a control unit to determine the closed or opened state of the door according to the door closing/opening signal and to control an operation of the washing machine.

The door lock switch may include a door switch turned on/off according to the closing or opening of the door and a main switch to power on or off an electrical part, and the door switch and the main switch may be configured by one switch.

The control unit may stop the operation of the washing machine if a determination is that the door is opened during the operation of the washing machine.

The door lock control device may further include a main motor driven to perform the operation of the washing machine, and the control unit may stop the driving of the main motor if a determination is made that the door is opened during the operation of the washing machine.

The control unit may output a door lock control signal if a determination is made that the door is closed, and a door lock relay to turn on a main switch according to the door lock control signal may be further included.

In accordance with another aspect, there is provided a door lock control device of a washing machine, the door lock control device including: a door; a door lock switch turned on/off according to opening or closing of the door to mechanically lock or unlock the door and to sense the closing or opening of the door; and a sensor to optically sense an operation state of the door lock switch (or door) and to output a door opening/closing signal, wherein the door lock switch senses whether the door is forcibly opened in a state in which the door is locked.

The door lock control device may further include a control unit to determine the opened or closed state of the door according to the door opening/closing signal and to output a door lock control signal if a determination is the door is closed, and a door lock relay to operate the door lock switch according to the door lock control signal.

The door lock switch may include a door switch, of a contact type which is turned on or off according to the closing or opening of the door to sense the closing or opening of the door, a main solenoid in which current flows according to an operation of the door lock relay, and a main switch switched by the main solenoid to power on or off an electrical part.

The door lock control signal may operate the door lock relay in a pulsed mode to enable current to flow in the main solenoid for a predetermined time.

The door switch may be connected between the main solenoid and a power supply, the main solenoid may be connected between the door lock relay and the door switch, and the main switch may connect the power supply and the electrical part.

The door lock switch may have three terminals to connect the door switch, the main solenoid and the main switch.

The door lock control device may further include a control unit to control an operation of the washing machine according to the door opening/closing signal, and a main motor driven under the control of the control unit, and the control unit may stop the driving of the main motor if a determination is made that the door is opened during the operation of the washing machine.

The door lock control device may further include a display unit to display an error message according to the stoppage of the main motor under the control of the control unit.

In accordance with another aspect, there is provided a door lock control method of a washing machine, the door lock control method including: operating a door lock switch to lock the door if a door is closed; performing an operation of the washing machine in a state in which the door is locked; sensing whether the door is opened during the operation of the washing machine; and stopping the operation of the washing machine if the door is sensed to be opened during the operation of the washing machine.

The door lock control method may further include sensing an operation state of the door lock switch and outputting a door opening/closing signal, and determining the opened or closed state of the door according to the door opening/closing signal and controlling the operation of the washing machine.

According to the door lock control device and method of the washing machine, since the door is locked or unlocked and the opening or closing of the door is sensed using one door lock switch without adding a separate switch to sense the opening or closing of the door, cost may be decreased.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
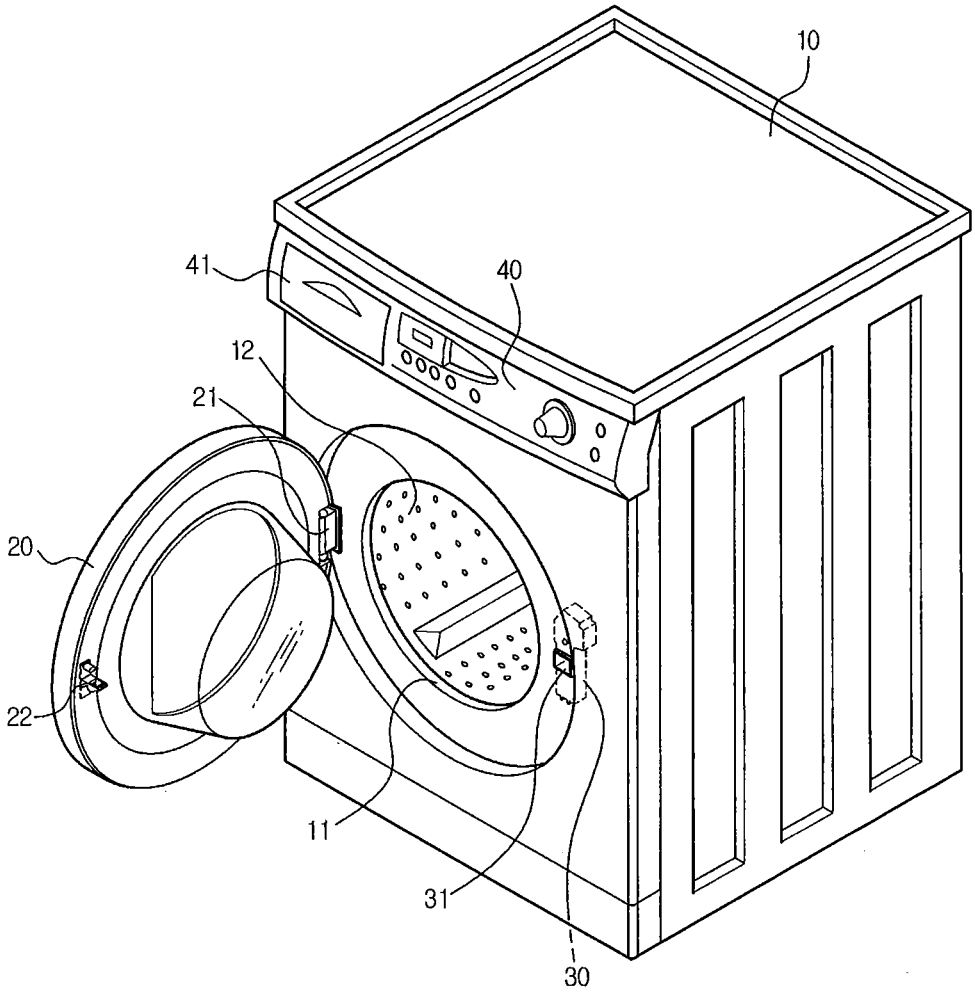
FIG. 1 is a perspective view showing the configuration of a washing machine according to an embodiment.

Reference will now be made in detail to the embodiments, examples of which are illustrated in the accompanying drawings, wherein like reference numerals refer to the like elements throughout. The embodiments are described below to explain the present invention by referring to the figures.

Reference will now be made in detail to the embodiments of the present invention, examples of which are illustrated in the accompanying drawings.

FIG. 1 is a perspective view showing the configuration of a washing machine according to an embodiment of the present invention.

In FIG. 1, the washing machine according to the embodiment includes a main body 10 substantially having a box shape and including an opening 11 formed in a front surface thereof to put or take laundry into or out of the washing machine, a cylindrical drum 12 rotatably mounted in the main body 12 to contain the laundry, and a door 20 provided in the front surface of the main body 10 to open or close the opening 11.

The door 20 is rotatably coupled to the main body 10 by a hinge member 21 provided on one side of the washing machine and is coupled to a door lock device 30 by a hook member 22 provided on the other side of the washing machine, and the door 20 is locked such that the door 20 is not opened during an operation of the washing machine.

A coupling member 31 to couple or decouple the hook member 22 to or from the main body 10 is formed in the door lock device 30 so as to lock or unlock the door 20.

In addition, a control panel 40 to control the washing machine is provided on an upper side of the front surface of the main body 10, and a detergent drawer 41 is provided on one side of the control panel 40.

Although not shown, a main motor is provided on an outer side of a rear surface of the drum 12 as a driving device to rotate the drum 12.

Figure 2:
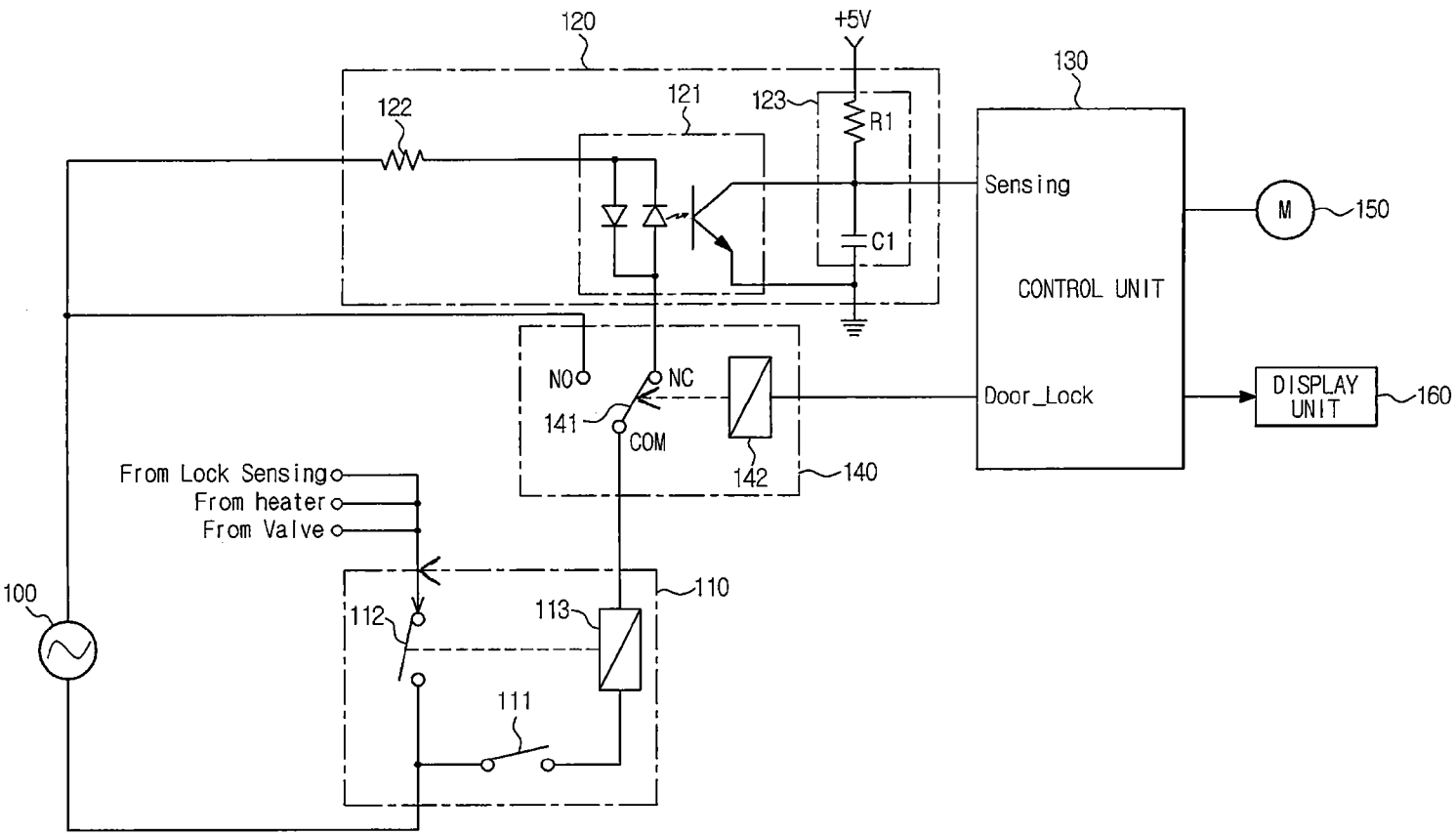
FIG. 2 is a diagram showing a door lock control circuit of a washing machine according to an embodiment.
Figure 3:
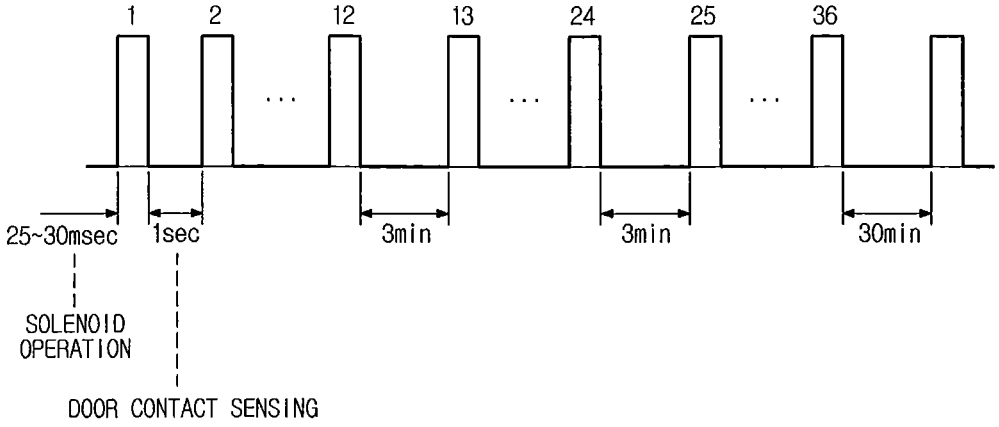
FIG. 3 is a pulse waveform diagram of a door lock control signal according to an embodiment.

FIG. 2 is a diagram showing a door lock control circuit of a washing machine according to an embodiment, and FIG. 3 is a pulse waveform diagram of a door lock control signal according to an embodiment.

In FIG. 2, a door lock control device of a washing machine of one embodiment includes a door lock switch 110 to lock/unlock the door 20 and to sense the closing or opening of the door 20, a sensor 120 to sense the closing or opening state of the door 20 according to an operation of the door lock switch 110 to output a door opening/closing signal, a control unit 130 to receive the door opening/closing signal from the sensor 120, to the lock/unlock of the door 20 and to control the operation of the washing machine, a 3-pole door lock relay 140 to operate the door lock switch 110 to power on or off an electrical part according to the door lock control signal of the control unit 130, a main motor 150 driven according to a motor control signal of the control unit 130, and a display unit 160 to display an operation state of the washing machine according to a display control signal of the control unit 130.

The door lock switch 110 includes a door (single) switch 111, of a contact type which is turned on/off according to the closing or opening of the door 20 to sense the closing or opening of the door 20, a main or solenoid operated switch 112 to power on/off the electrical part (a heater, a valve or the like), and a main solenoid 113 in which current flows according to an operation of the door lock relay 140 control a switching operation of the main switch 112.

The sensor part 120 includes a photo-coupler 121 to sense optically a contact state of the door switch 111 according to the on/off state of the door switch 111 and to output the door opening/closing signal to an input terminal (Sensing) of the control unit 130, a current limit resistor 122 to limit current of a power supply 100 applied to the photo-coupler 121, and an integrator 123 to stabilize the current value of the door opening/closing signal input to the input terminal (Sensing) of the control unit 130. The integrator 123 includes a resistor R1 and a capacitor C1.

The control unit 130 determines the opening or closing state of the door 20 according to the door opening/closing signal received from the sensor part 120 and controls the driving of the door lock relay 140 and the driving of the main motor 150. For example, if the control unit 130 determines that the door 20 is closed, the control unit outputs a door lock control signal to the door lock relay 140 through an output terminal (Door_Lock). The door lock control signal output through the output terminal (Door_Lock) is shown in FIG. 3.

In FIG. 3, in the door lock control signal, a rectangular pulse for a predetermined time (25 to 30 msec) is output such that the door lock relay 140 operates in a pulsed mode, and a time interval between pulses is gradually increased (1 sec, 3 min, 30 min, . . . ) according to the number of times of sensing of the contact of the door switch 111 to protect the door lock relay 140.

The door lock relay 140 includes a 3-pole switch 141 to switch terminals COM, NC and NO to control the switching operation of the main switch 112 according to the door lock control signal output from the output terminal (Door_Lock) of the control unit 130 and a control solenoid 142 in which current flows according to the door lock control signal to switch the terminals of the 3-pole switch 141.

Accordingly, when the door lock relay 140 receives the door lock control signal shown in FIG. 3 from the control unit 130, current flows in the control solenoid 142 for the predetermined time (25 to 30 msec) such that the common terminal COM of the 3-pole switch 141 is switched from the normally closed terminal NC to the normally open terminal NO. When the common terminal COM of the 3-pole switch 141 is switched from the normally closed terminal NC to the normally open terminal NO, current flows in the main solenoid 113 of the door lock switch 110 to turn on the main switch 112 such that the door 20 is mechanically locked.

Thereafter, when the predetermined time (25 to 30 msec) elapses, the rectangular pulse input to the control solenoid 142 of the door lock relay 140 becomes a low level, the current flowing in the control solenoid 142 is cut off, and the common terminal COM of the 3-pole switch 141 is switched from the normally open terminal NO to the normally closed terminal NC again. At this time, the main switch 112 of the door lock switch 110 is held at the on state and thus the door 20 is successfully locked.

The main motor 150 performs or stops the operation of the washing machine including a washing cycle, a rinsing cycle and a dehydrating cycle according to the motor control signal of the control unit 130. For example, when the control unit 130 determines that the door 20 is opened, the driving of the main motor 150 is stopped such that the operation of the washing machine is stopped.

The display unit 160 displays the operation state of the washing machine to a user according to the display control signal from the control unit 130 and displays an error message if the user operates the washing machine in a state in which the door 20 is opened or if the door 20 is forcibly opened during the operation of the washing machine.

Hereinafter, the operation of the door lock control device of the washing machine and the effect thereof will be described.

Prior to the description of the operation, the common terminal COM is connected to the normally closed terminal NC in the 3-pole switch 141 of the door lock relay 140.

Figure 4:
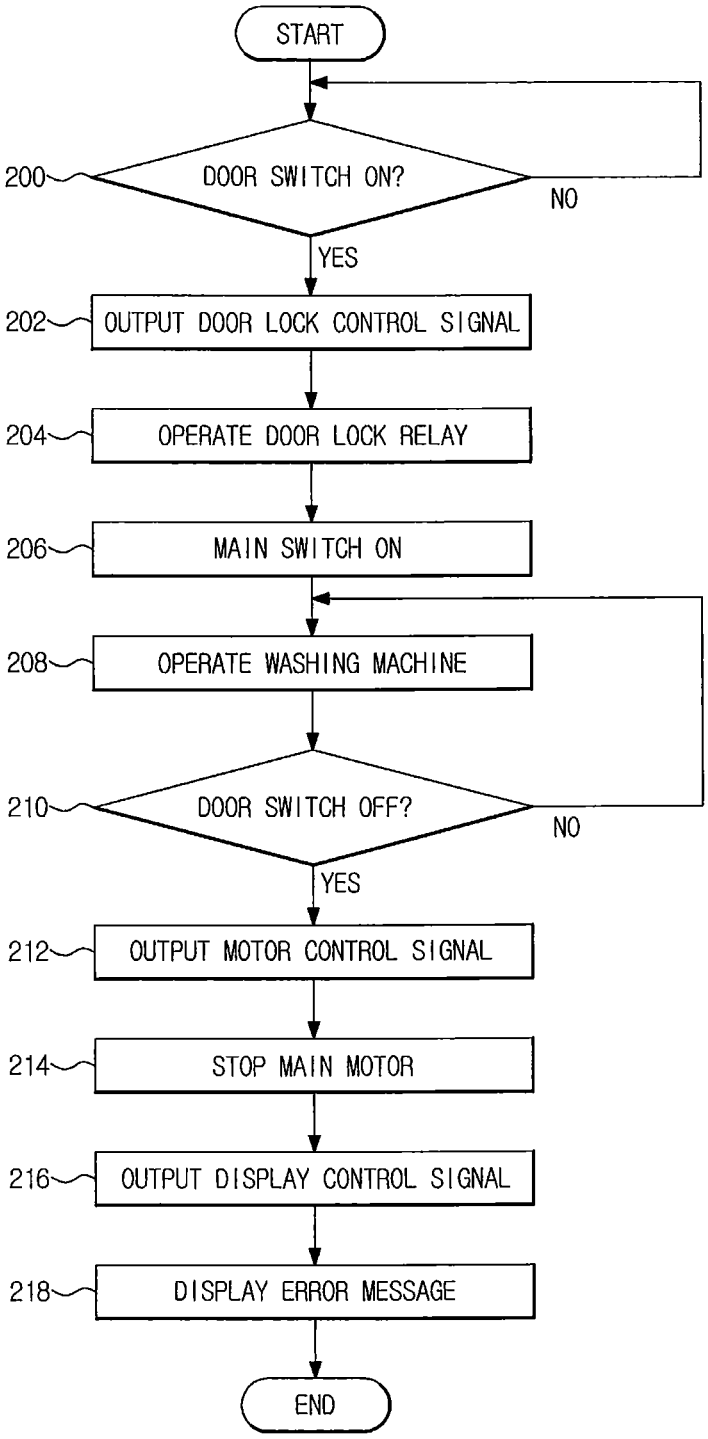
FIG. 4 is a flowchart illustrating a door lock control method of a washing machine according to an embodiment.

FIG. 4 is a flowchart illustrating a door lock control method of a washing machine according to an embodiment.

Figure 5:
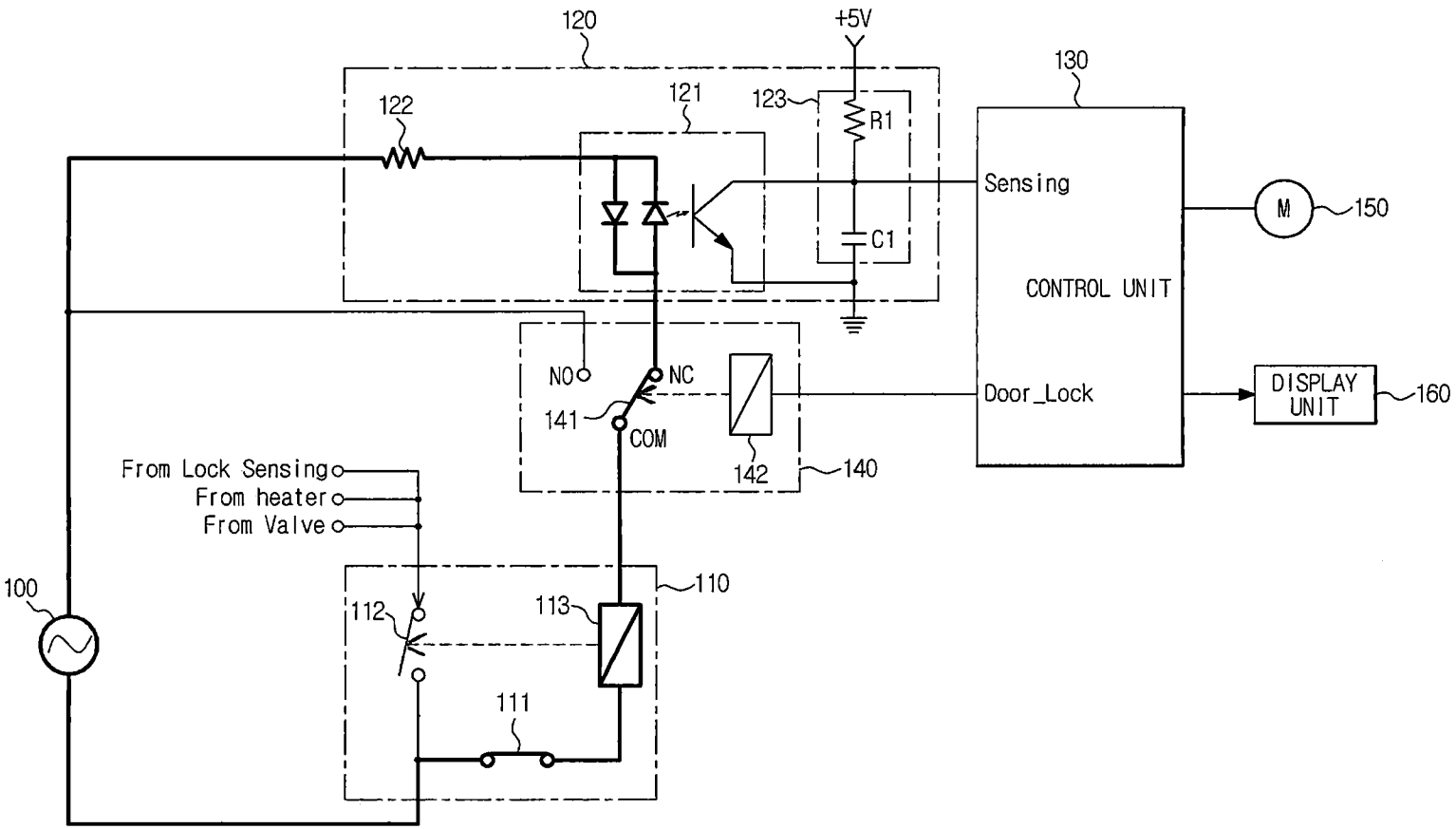
FIG. 5 is a diagram showing a closed loop which is formed in order to sense the opening or closing of a door of a washing machine according to an embodiment.

In FIGS. 4 and 5, when the door 20 of the washing machine is closed, the contact of the door switch 111 of the door lock switch 110 is closed. If the contact of the door switch 111 is closed, the current of the power supply 100 flows to the 3-pole switch 141 of the door lock relay 140 through the photo-coupler 121 of the sensor unit 120. At this time, in the 3-pole switch 141 of the door lock relay 140, since the common terminal COM is connected to the normally closed terminal NC, the current passes through the 3-pole switch 141 so as to form a closed loop from the door switch 111 of the door lock switch 110 to the power supply (see a thick line of FIG. 5).

Since minute current flows in the photo-coupler 121 through the contact of the door switch 111, the photo-coupler 121 senses the contact state of the door switch 111 and outputs the door opening/closing signal to the input terminal (Sensing) of the control unit 130.

Accordingly, the control unit 130 determines the opened/closed state of the door 20 according to the door opening/closing signal received from the sensor unit 120 and determines whether the door switch 111 is turned on (200).

As the result of the determination of Operation 200, when the door switch 111 is turned on, the control unit 130 determines that the door 20 is closed and outputs the door lock control signal to the door lock relay 140 through the output (Door_Lock) (202).

In the door lock control signal, as shown in FIG. 3, the rectangular pulse is output for a predetermined time (about 25-30 msec) such that the door lock relay 140 operates in the pulsed mode, and the time interval between pulses is gradually increased (1 sec, 3 min, 30 min, . . . ) according to the number of times of sensing of the contact of the door switch 111 to protect the door lock relay 140.

Accordingly, in the door lock relay 140, the current flows in the control solenoid 142 for the predetermined time (25 to 30 msec) according to the door lock control signal output from the output terminal (Door_Lock) of the control unit 130 and the common terminal COM of the 3-pole switch 141 is switched from the normally closed terminal NC to the normally open terminal NO (204).

Figure 6:
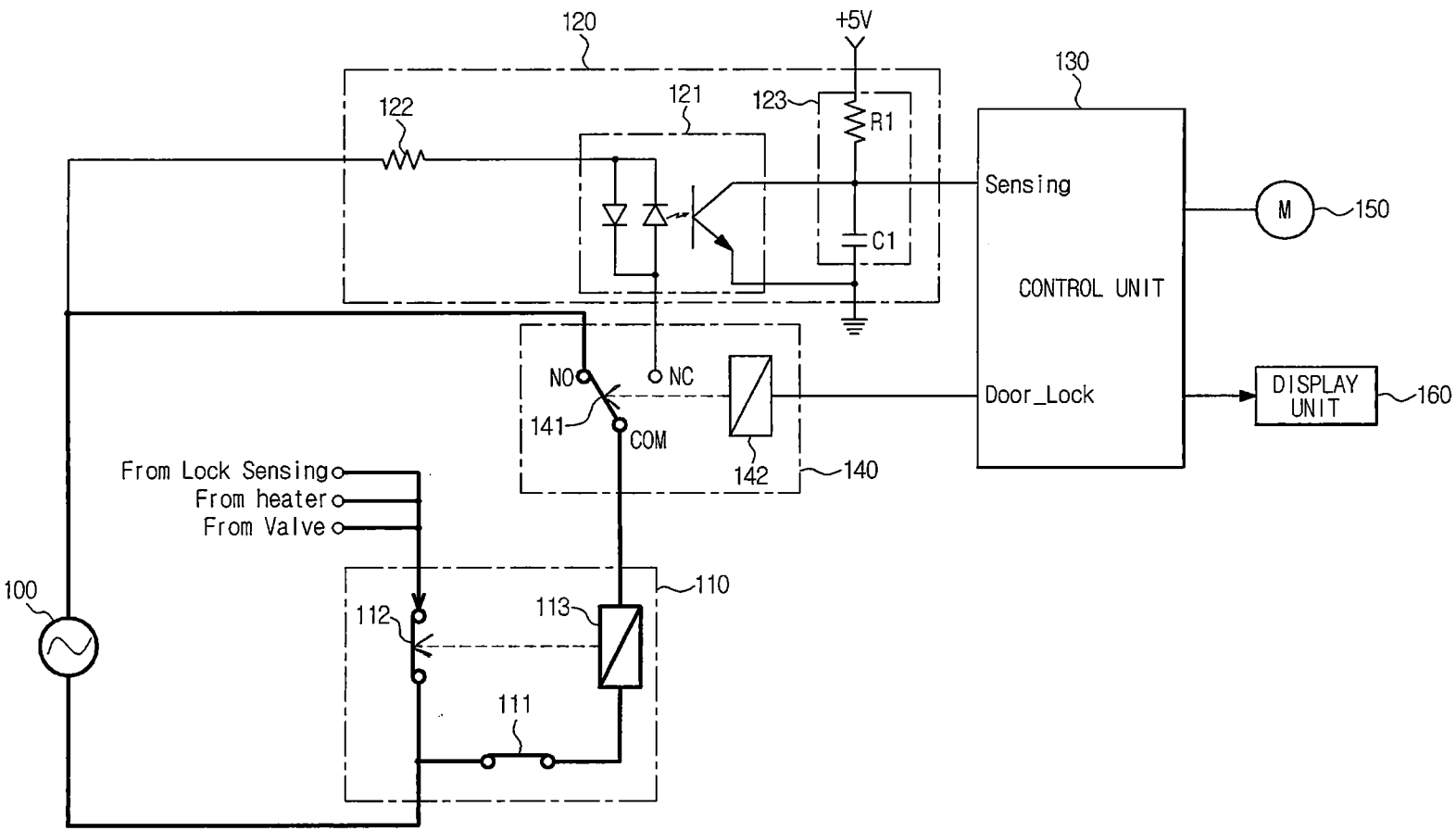
FIG. 6 is a diagram showing a closed loop which is formed in order to control a lock operation of a door of a washing machine according to an embodiment.

When the common terminal COM of the 3-pole switch 141 is switched from the normally closed terminal NC to the normally open terminal NO, current of the power supply 100 flows to the main solenoid 113 of the door lock switch 110 through the common terminal COM and the normally open terminal NO of the 3-pole switch 141 of the door lock relay 140. At this time, the current passing through the main solenoid 113 forms a closed loop from the door switch 111 to the power supply (see a thick line of FIG. 6).

Accordingly, the current flows in the main solenoid 113 of the door lock switch 110, the main switch 112 is turned on, and the door 20 is mechanically locked (206).

When the main switch 112 is turned on and the door is successfully locked, the operation of the washing machine including the washing cycle, the rinsing cycle and the dehydrating cycle is performed according to a washing condition selected by the user (208).

If the door 20 is forcibly opened during operation of the washing machine for some reason, only the door 20 is opened in a state in which the main switch 112 is turned on. When the door 20 is opened, the contact of the door switch 111 of the door lock switch 110 is opened. If the contact of the door switch 111 is opened, the current of the power supply 100 does not flow to the 3-pole switch 141 of the door lock relay 140 through the photo-coupler 121 of the sensor unit 120. At this time, since the common terminal COM and the normally closed terminal NC are connected again in the 3-pole switch 141 of the door lock relay 140, minute current does not flow in the photo-coupler 121. Thus, the photo-coupler 121 senses the contact state of the door switch 111 and outputs the door opening/closing signal to the input terminal (Sensing) of the control unit 130.

Accordingly, the control unit 130 determines the opened or closed state of the door 20 according to the door opening/closing signal received from the sensor unit 120 and determines whether the door switch 111 is turned off (210).

As the result of determination of Operation 210, when the door switch 111 is turned off, the control unit 130 determines that the door 20 is opened and outputs the motor control signal to the main motor 150 (212).

Then, the main motor 150 is stopped according to the motor control signal of the control unit 130 so as to stop the operation of the washing machine (214).

In addition, the control unit 130 outputs the motor control signal and outputs the display control signal to the display unit 160 (216).

Accordingly, the display unit 160 displays an error signal according to the display control signal of the control unit 130 (218).

Although the door lock control device is applied to a washing machine in the embodiments, the embodiments are not limited thereto. Even when the embodiments are applied to a dish washer, a drier, a cooker or the like, the same advantages may be obtained as in the embodiments.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A door lock control device of a washing machine, the door lock control device comprising:

a door;

a door lock configured to mechanically lock the door;

a door lock switch including a door switch turned on and off according to a closing or opening of the door, a main switch to power on or off electrical parts of the washing machine, and a first solenoid in which current flows according to an operation of a door lock relay, to control a switching operation of the main switch;

a photo-coupler sensor to optically sense an operation state of the door switch and to output a door closing or opening signal;

a control unit to determine a closed or opened state of the door according to the door closing or opening signal and to output a door lock control signal;

the door lock relay includes a relay switch to switch between a first terminal and a second terminal to control the switching operation of the main switch based on the output door lock control signal and a second solenoid in which current flows according to the output door lock control signal, to control a switching operation of the relay switch;

a main motor driven under the control of the control unit, wherein the control unit stops the driving of the main motor if the control unit determines the door is opened during operation of the washing machine; and a display unit to display an error message when the driving of the main motor is stopped when the control unit determines that the door is opened during the operation of the washing machine, wherein the relay switch comprises a common terminal coupled to the first solenoid and is configured to electrically connect the common terminal with the first terminal coupled to a power source such that the first solenoid operates the main switch to be turned on when the door is closed.

2. The door lock control device according to claim 1, wherein the control unit stops the operation of the washing machine if a determination is that the door is opened during the operation of the washing machine.

3. The door lock control device according to claim 1, wherein when the control unit outputs a door control signal based on a determination that the door is in the closed state, the door control signal is output in pulses for a predetermined amount of time and current flows in the second solenoid for the predetermined amount of time.

4. The door lock control device according to claim 3, wherein a time interval between pulses increases over time.

5. The door lock control device according to claim 1, wherein when the door switch is turned on and the door is closed, current of the power source flows from the power source to the photo-coupler sensor, from the photo-coupler sensor to the second terminal, from the second terminal to the common terminal, and from the common terminal to the first solenoid.

6. A door lock control device of a washing machine, the door lock control device comprising:

a door;

a door lock configured to mechanically lock the door;

a door lock switch including a door switch turned on and off according to a closing or opening of the door, a main switch to power on or off electrical parts of the washing machine, and a first solenoid in which current flows according to an operation of a door lock relay, to control a switching operation of the main switch;

a photo-coupler sensor to optically sense an operation state of the door switch and to output a door opening or closing signal;

a control unit to determine a closed or opened state of the door according to the door closing or opening signal and to output a door lock control signal;

the door lock relay includes a relay switch to switch between first and a first terminal and a second terminal to control the switching operation of the main switch based on the output door lock control signal and a second solenoid in which current flows according to the output door lock control signal, to control a switching operation of the relay switch; and a main motor driven under the control of the control unit, wherein the relay switch comprises a common terminal coupled to the first solenoid and is configured to electrically connect the common terminal with the first terminal coupled to a power source such that the first solenoid operates the main switch to be turned on when the door is closed, wherein the door switch senses whether the door is forced open when operation of the washing machine requires the door to be locked, and wherein the control unit stops the driving of the main motor if the control unit determines that the door is opened during the operation of the washing machine.

7. The door lock control device according to claim 6, wherein the door lock control signal operates the door lock relay in a pulsed mode to enable current to flow in the first solenoid for a predetermined time.

8. The door lock control device according to claim 6, wherein the door switch is connected between the first solenoid and a power supply, the first solenoid is connected between the door lock relay and the door switch, and the main switch connects the power supply and the electrical parts.

9. The door lock control device according to claim 6, wherein when the main switch is switched on to power on the electrical parts and the door is forced open from a locked position, the door switch is opened, the photo-coupler sensor senses a contact state of the door switch as being open, and the photo-coupler sensor outputs the door opening or closing signal indicating that the door is open.

10. A door lock control method for a door of a washing machine, the door lock control method comprising:

operating a door lock switch, which includes a door switch turned on and off according to a closing or opening of the door, wherein the door comprises a door lock to mechanically lock the door;

controlling, by the door lock switch, a switching operation of a main switch included in the door lock switch, the main switch being operable to power on or off electrical parts of the washing machine;

operating a door lock relay to control a flow of current through a first solenoid included in the door lock switch;

optically sensing, using a photo-coupler sensor, operation state of the door switch during operation of the washing machine and outputting a door opening or door closing signal;

determining, by a control unit, a closed or opened state of the door according to the door closing or opening signal and outputting a door lock control signal, wherein the door lock relay includes a relay switch to switch between a first terminal and a second terminal to control the switching operation of the main switch based on the outputting of the door lock control signal by the control unit and a second solenoid in which current flows according to the outputting of the door lock control signal by the control unit, to control a switching operation of the relay switch, wherein the relay switch comprises a common terminal coupled to the first solenoid and is configured to electrically connect the common terminal with the first terminal coupled to a power source such that the first solenoid operates the main switch to be turned on when the door is closed, controlling, by the control unit, a main motor to be driven during the operation of the washing machine;

sensing, by the door switch, whether the door is forced open when the operation of the washing machine requires the door to be locked; and stopping the driving of the main motor if the control unit determines the door is opened during the operation of the washing machine.

* * * * *

UNITED STATES PATENT AND TRADEMARK OFFICE

CERTIFICATE OF CORRECTION

PATENT NO. : 9,163,347 B2
APPLICATION NO. : 12/883853
DATED : October 20, 2015
INVENTOR(S) : Ha Yeong Yang It is certified that error appears in the above-identified patent and that said Letters Patent is hereby corrected as shown below:

Title Page, Column 1 (Title), Line 2
After "WASHING" insert -- MACHINE --.

IN THE SPECIFICATION

Column 1, Line 2
After "WASHING" insert -- MACHINE --.

IN THE CLAIMS

Claim 6, Column 8, Line 17
After "between" delete "first and".

Signed and Sealed this
Twenty-ninth Day of March, 2016

Michelle K. Lee

Michelle K. Lee
*Director of the United States Patent and Trademark Office*